US005920917A

United States Patent [19]

Landsberger

[11] Patent Number: 5,920,917

[45] Date of Patent: Jul. 13, 1999

[54] TOILET SEAT INCLUDING HEIGHT INCREASING APPARATUS

[75] Inventor: Kurt Landsberger, Verona, N.J.

[73] Assignee: Bel-Art Products, Inc., Pequannock, N.J.

[21] Appl. No.: 08/754,796

[22] Filed: Nov. 21, 1996

Related U.S. Application Data

[63] Continuation-in-part of application No. 08/566,933, Dec. 4, 1995, abandoned.

[51] Int. Cl.[6] ..... A47K 13/00

[52] U.S. Cl. ..... 4/235; 004/254

[58] Field of Search ..... 4/235, 236, 239, 4/240, 254

[56] References Cited

U.S. PATENT DOCUMENTS

| | | | |
|---|---|---|---|
| 2,773,542 | 12/1956 | Chasin | 4/254 X |
| 4,343,052 | 8/1982 | Guenther | 4/254 |
| 4,398,307 | 8/1983 | Ginsburg et al. | 4/236 |
| 4,882,791 | 11/1989 | Kimes | 4/254 |
| 4,965,889 | 10/1990 | Tissot et al. | 4/240 X |
| 5,251,338 | 10/1993 | Light | 4/235 |

FOREIGN PATENT DOCUMENTS

| | | | |
|---|---|---|---|
| 804900 | 1/1974 | Belgium . | |
| 1208432 | 2/1960 | France | 4/254 |
| 2336906 | 7/1977 | France . | |
| 2177735 | 1/1987 | United Kingdom . | |

OTHER PUBLICATIONS

Sales Brochure "Elevated Toilet Seats", pg. 32, dated Jul. 2 1992, class 4 sub 254.

*Primary Examiner*—Robert M. Fetsuga
*Attorney, Agent, or Firm*—Lawrence G. Fridman

[57] ABSTRACT

A toilet height conversion structure for use in combination with a toilet having a rear portion and a supporting frame which includes at least a substantially horizontal support member and a pair of substantially vertical inner support members. The structure consists of a mounting block positioned at the rear portion of the toilet and a riser. A transverse channel arrangement is formed in the mounting block for securing the horizontal support member and preventing transverse movement of the frame relative to the toilet. The mounting block is also formed with a lateral channel arrangement for securing the pair of vertical inner support members and preventing lateral movement of the frame relative to the toilet. An adjustable connecting arrangement is formed in the mounting block for securing thereof at the rear portion of the toilet.

19 Claims, 8 Drawing Sheets

TOILET SEAT INCLUDING HEIGHT INCREASING APPARATUS

This application is a Continuation-in-Part application of U.S. patent application Ser. No. 60/566,933 filed Dec. 4, 1995, abandoned.

FIELD OF THE INVENTION

This invention relates to toilet seats and more particularly to a toilet seat including apparatus for increasing the height of a conventional toilet seat so that the toilet can be readily used by the elderly of infirm.

BACKGROUND OF THE INVENTION

A variety of raised toilet seats are available. Generally, these seats include a raised portion which fits on top of the bowl of a conventional toilet when in use and removed therefrom when not in use. These seats serve the needs of those who are unable to lower or raise themselves from a conventional toilet seat. One such toilet seat which serves the purposes described is covered by U.S. Pat. No. 4,477,932 issued to Lenosky and assigned to the assignee of the present invention.

The problem with toilet seats of this type is that since the raised seat is superimposable on the bowl of the conventional toilet only when the lid and seat of the toilet are in a raised position, they do not allow for closure of the seat by means of lowering the lid when the raised seat is in position. The present invention avoids this situation by providing a toilet seat including apparatus which enables the conventional toilet seat and lid to be utilized in the conventional manner, i.e. both being raised and lowered, as the case may be, to give the toilet a more conventional appearance, as will be recognized as advantageous.

The present invention also provides a raised toilet seat which receives and stabilizes a user supporting frame, so as to minimize its transverse and lateral movements relative to the toilet which is important to those who need additional assistance.

U.S. Pat. No. 5,251,338 issued to Homer E. Light discloses toilet height conversion apparatus, but differs from the present invention in many respects as will be discerned from the description thereof which follows.

SUMMARY OF THE INVENTION

One aspect of the present invention provides a toilet height conversion structure for use in combination with a support frame associated with toilet having at least a rear portion, whereas the supporting frame includes at least a substantially horizontal member. The structure consists of a mounting block positioned at a rear portion of a toilet, a riser and adjustable connecting arrangement. The riser arrangement is adapted for raising the effective height of a toilet seat. The riser arrangement is pivotably connected to the mounting block for movement between raised and lowered position of the riser arrangement relative to the toilet. The adjustable connecting arrangement is provided for securing the mounting block to the rear portion of the toilet. The mounting block is formed with a transverse channel arrangement for securing a substantially horizontal support member of a supporting frame and preventing transverse movement of the supporting frame relative to the toilet. The supporting frame also includes a pair of substantially vertical inner support members and the mounting block includes a lateral channel arrangement for securing a pair of substantially vertical inner support members to prevent lateral movement of the supporting frame relative to the toilet. The mounting block further includes opposed top and bottom block walls and said bottom block wall is positioned upon the toilet rear portion. The transverse channel arrangement is formed at said bottom block wall defining a substantially horizontal transverse channel passing through the mounting block, so that the horizontal support member of the supporting frame is positioned within the substantially horizontal transverse channel. The mounting block further includes opposed block side walls and the lateral channel arrangement is formed at the opposed block side walls defining a pair of substantially vertical channels in alignment with ends of the substantially horizontal transverse channel, so that the substantially vertical inner support members are positioned in the pair of substantially vertical channels.

According to another aspect of the invention, the mounting block includes opposed mounting side members defining opposed detent recesses and the riser arrangement includes opposed riser side walls having a pair of pivot pins provided for alignment and engagement with the detent recesses. The riser arrangement is made of a biasable material and mounting side members further include a tapered portion for initially accepting the pair of pins during the mounting of the riser means of the mounting block and directing the pins to the detent recesses, so that the riser means is movable between a non-biased mode to a biased mode during the mounting and self-biased from the biased mode to the non-biased mode upon engagement with said detent recesses.

According to a further aspect of the invention the adjustable connecting arrangement is a single elongated transversely extending slot extending between the top and bottom block walls and generally between the block sides, so that the single elongated slot is capable of being aligned with a plurality of possible spacings of preformed mounting holes defined in the toilet.

Alternatively, the slot arrangement in the mounting block can be a pair of elongated slots extending between the top and bottom walls and passing through the block sides, so that apertures are defined at junctions of the block sides with the elongated slots facilitating securing of the block to the toilet. The mounting block can be also formed with a pair of elongated transversely extending slot arrangements extending between the top and bottom walls and generally between the block sides. Each slot arrangement includes two mating elongated transversely extending slots and a lateral slot for joining the mating slots.

Yet another aspect of the invention provides a supporting frame comprising a pair of substantially vertical legs having leg upper and lower ends positioned at the front end of the toilet, whereas the leg lower ends rest upon a support surface. The support frame also includes a pair of substantially horizontal arms having arm front and rear ends extending laterally along opposed sides of the toilet between the front and rear toilet ends. The arm front ends being connected to the leg upper ends and the arm rear ends terminate at the rear of the toilet. A pair of substantially vertical outer support members have outer support member upper and lower ends. The outer support member upper ends being connected to the arm rear ends. A pair of substantially horizontal upper support members extend transversely relative to the rear portion of the toilet and have upper support member outer and inner ends, so that upper support member outer ends are connected to the outer support member ends. A pair of substantially vertical inner support members have inner support member upper and lower ends, the inner support member upper ends are connected to the upper support member inner ends. For example, support member having opposed horizontal support member ends is connected to the vertical inner support member lower end.

BRIEF DESCRIPTION OF THE DRAWINGS

Other advantages and features of the invention are described with reference to exemplary embodiments, which are intended to explain and not to limit the invention, and are illustrated in the drawings in which.

DETAILED DESCRIPTION OF THE INVENTION

Figure 1:
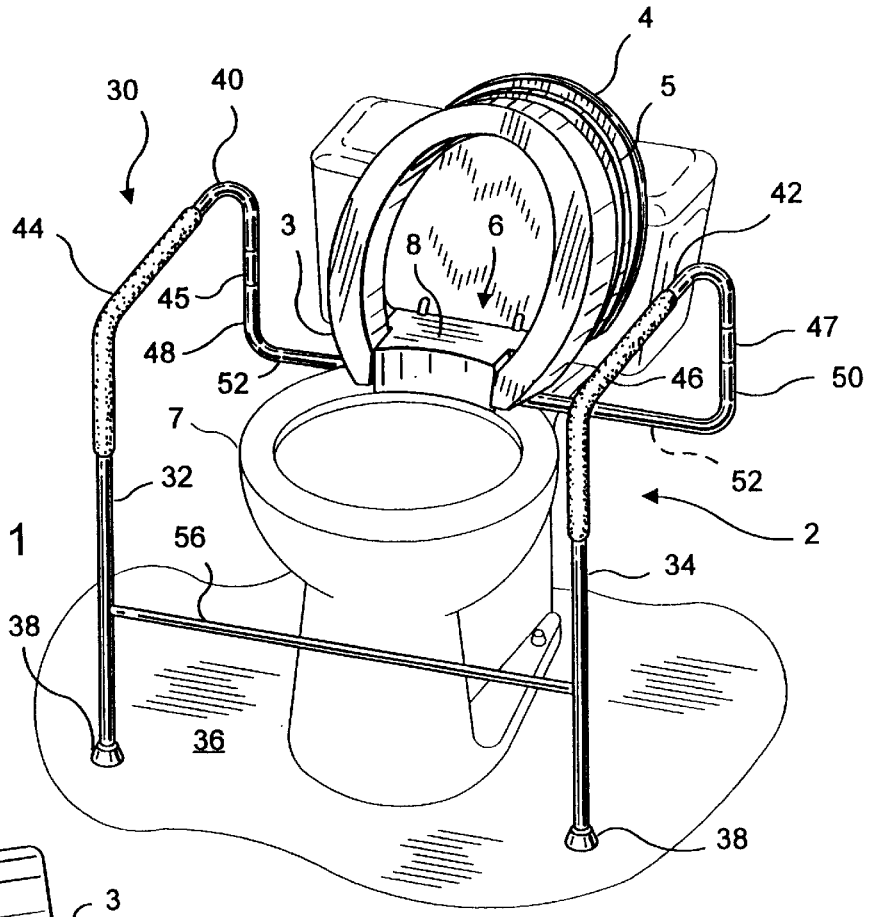
FIG. 1 is a perspective view illustrating the invention.

As best illustrated in FIGS. 1–5, a toilet 2 has a riser 3, a toilet lid 4 and a toilet seat 5. The lid 4 is mounted to the seat 5 in a conventional manner. A toilet seat height increasing apparatus 6 includes a mounting block 8 which directly and indirectly supports the riser 3, lid 4 and seat 5 to provide a raised toilet seat which is particularly advantageous for use by those who have difficulty in lowering and raising themselves from a conventional toilet seat, or need assistance in doing so, as will be appreciated.

Figure 2:
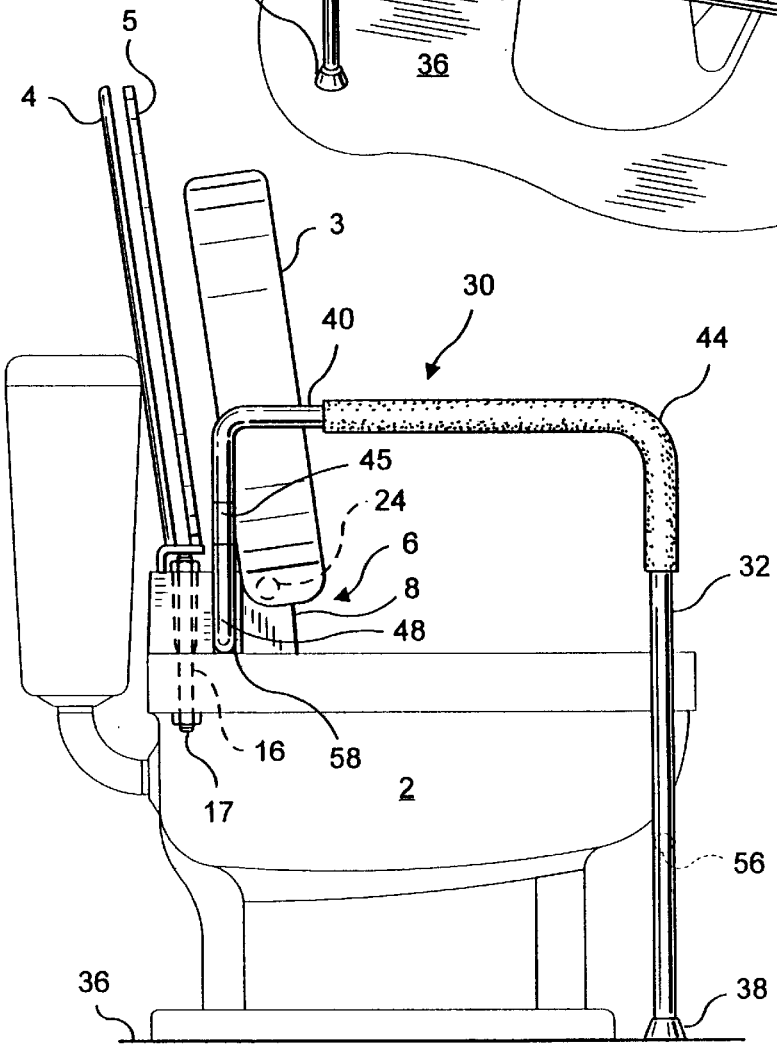
FIG. 2 is a side elevation view thereof.
Figure 3:
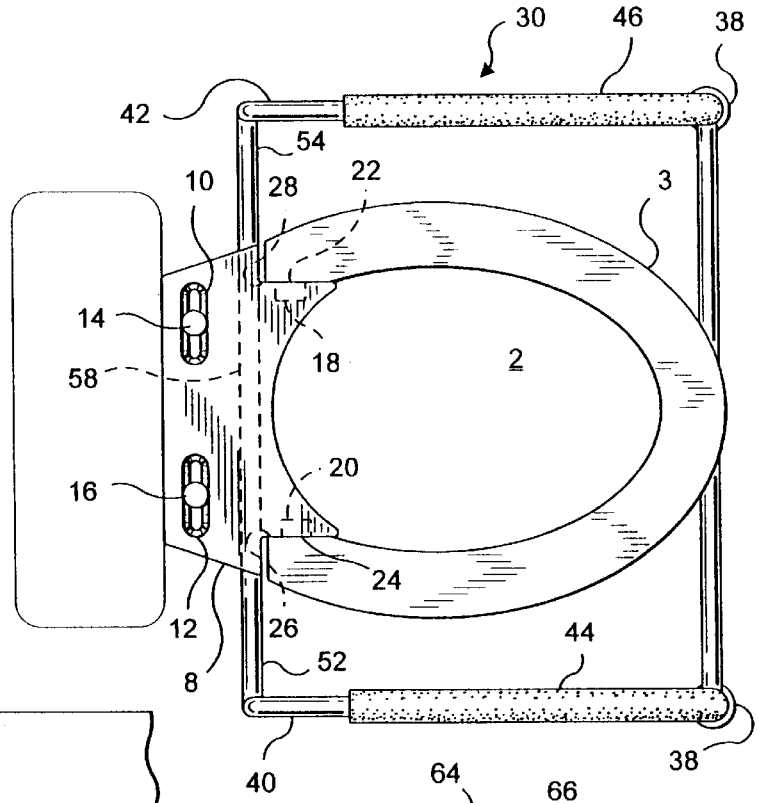
FIG. 3 is a top plan view thereof.

In the embodiment of FIG. 3, the mounting block 8 is formed with elongated through slots 10 and 12. The slots 10 and 12 are transverse relative to the front/rear orientation of toilet 2. Bolts or similar features 14 and 16 extend through the slots 10 and 12, respectively, and extend through holes provided at the rear of toilet 2 so as to be secured thereon via securing means 17 such as nuts as shown in FIG. 2. Toilet seat 5 and mounting block 8 are thus secured to toilet 2 by upper and lower bolt fasteners 14 and 16. As also shown in FIG. 2, the seat 5 with the lid 4 are pivotably connected via a flange to the upper portions of bolts 14 and 16 and thus can pivot up and down toward and away from the toilet 2. In use, the riser 3 rests on the bowl 7 of the toilet 2 as shown in FIG. 3.

With reference to FIG. 3, wherein the lid 4 and the seat 5 are not shown for purposes of clarity, the block 8 includes a pair of pin recesses or detents 18 and 20 on opposite sides thereof, respectively. The pin recesses or detents 18 and 20, as described in greater detail later on in the specification, are adapted to receive pins 22 and 24 on the riser 3, whereby the riser 3 pivots up and down away from and toward the toilet 2 in a similar manner. The lid 4 and the seat 5 pivot up and down away from and toward the riser 3.

The front of the block 8 is contoured to match the contour of the riser 3, the lid 4 and the seat 5. The detents 18 and 20 are disposed in clearance steps 26 and 28 in the block 8. The height of the riser 3 corresponds to the height of the block 8.

The elongated slots 10 and 12 are provided to accommodate a variation in the spacing of the holes 14 and 16 in the toilet 2 a may be the case particularly in countries other than the United States. The block 8 is also adapted to support as user supporting frame 30. This feature of the invention is important to those who might otherwise need assistance in using toilet 2 even with its height increasing apparatus.

Thus, with reference mainly to FIG. 1, supporting the frame 30 includes a pair of substantially vertically extending parallel legs 32 and 34 having lower ends which rest on a supporting surface 36 through resilient tips 38, as the case may be. The legs 32 and 34 terminate at their upper ends in substantially horizontally extending parallel arms 40 and 42. The arms 40 and 42 and the upper parts of the legs 32 and 34 which are covered with a resilient tubing 44 and 46, respectively, for comfort purposes extend rearwardly to the back of the toilet 2 and thereupon terminate in substantially vertically and downwardly extending parallel members 48 and 50, respectively. The members 48 and 50 terminate in a substantially horizontal member 52. A brace 56 is supported between the lower portions of the legs 32 and 34.

The frame 30 of the Invention (see FIG. 1) can be formed having independent first and second side components as well as an attaching component. The first component includes the leg 32, arm 40 and an upper part of the member 48. In a similar manner, the second side component consists of the leg 34, arm 42 and an upper part of the member 50. The attaching component is formed by the horizontal member 52 and lower parts of the members 50 and 48 attached thereto. In this embodiment of the Invention, to connect the first, second side components and the attaching components together connecting arrangements or any conventional connecting means 45 and 47 are provided in the central regions of the members 48 and 50 correspondingly. Such arrangement facilitates assembly and transportation of the frame 30. It should be noted, however, that formation of the frame as a unitary structure without the connecting arrangements 45 and 47 is also contemplated.

Figure 4:
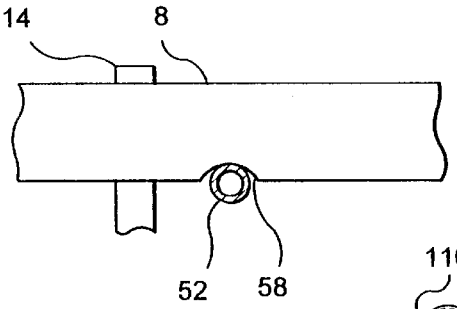
FIG. 4 is a diagrammatic representation illustrating means for securing a user supporting frame to the toilet.

With particular reference to the embodiment of FIGS. 3 and 4, the underside of the block 8 includes a longitudinal channel 58. The channel 58 receives the member 52 of the supporting frame 30. With the arrangement described, frame member 52 is clamped in channel 58 so as to be held secure therein, whereby the entire frame 30 is secured to the block 8, when the bolts 14 and 16 are tightened to the toilet 2 via the nuts 17, as illustrated and described with reference to FIGS. 2 and 3.

In accordance with the description of the invention above, a riser is provided which has the advantage of being able to utilize a conventional toilet so as to increase the height of the toilet seat for advantageous use by those who would otherwise have difficulty using same.

Figure 5:
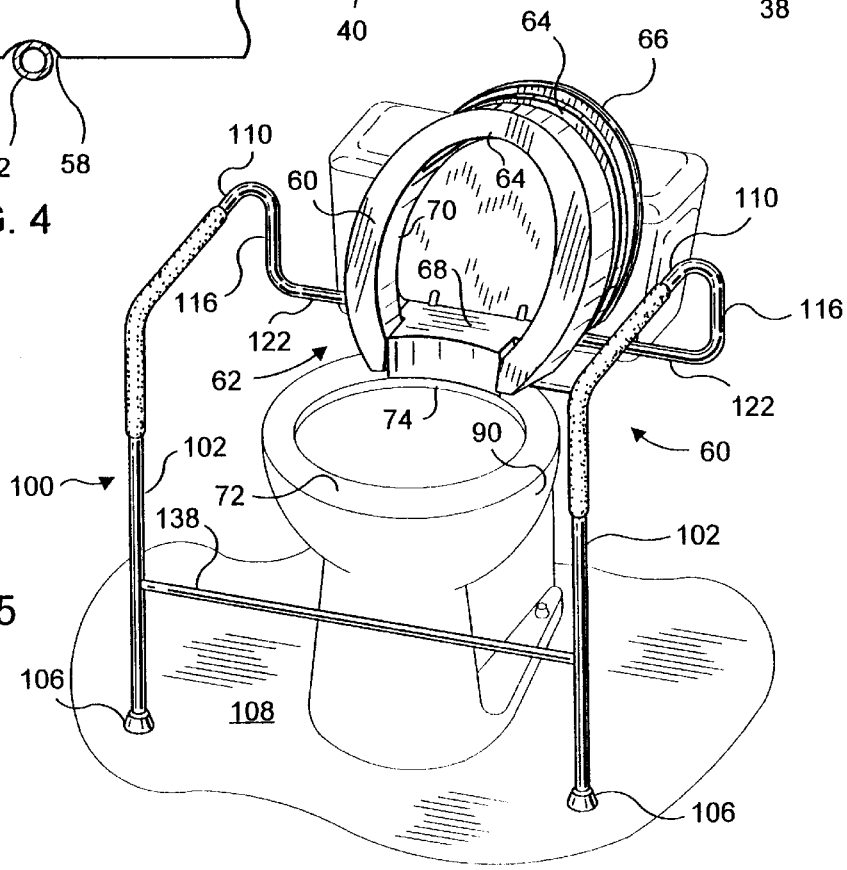
FIG. 5 is a perspective view illustrating another embodiment of the invention with added inventive features.
Figure 7:
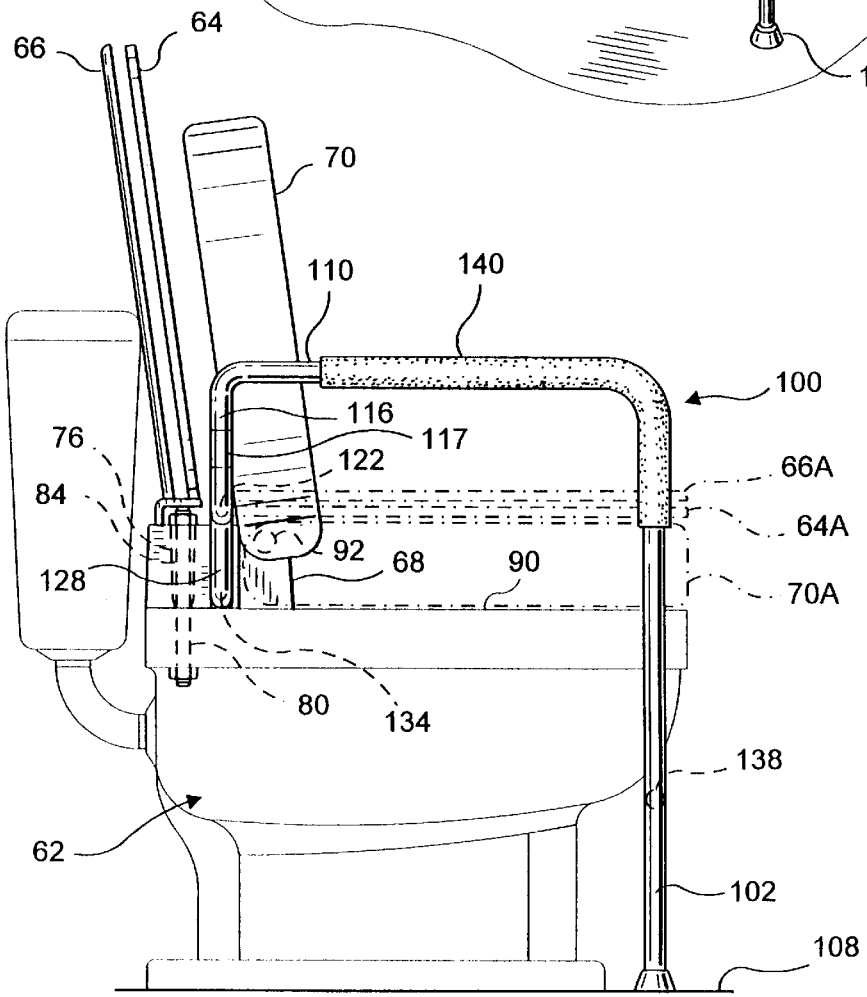
FIG. 7 is a side elevation view of the embodiment shown in FIG. 5.
Figure 8:
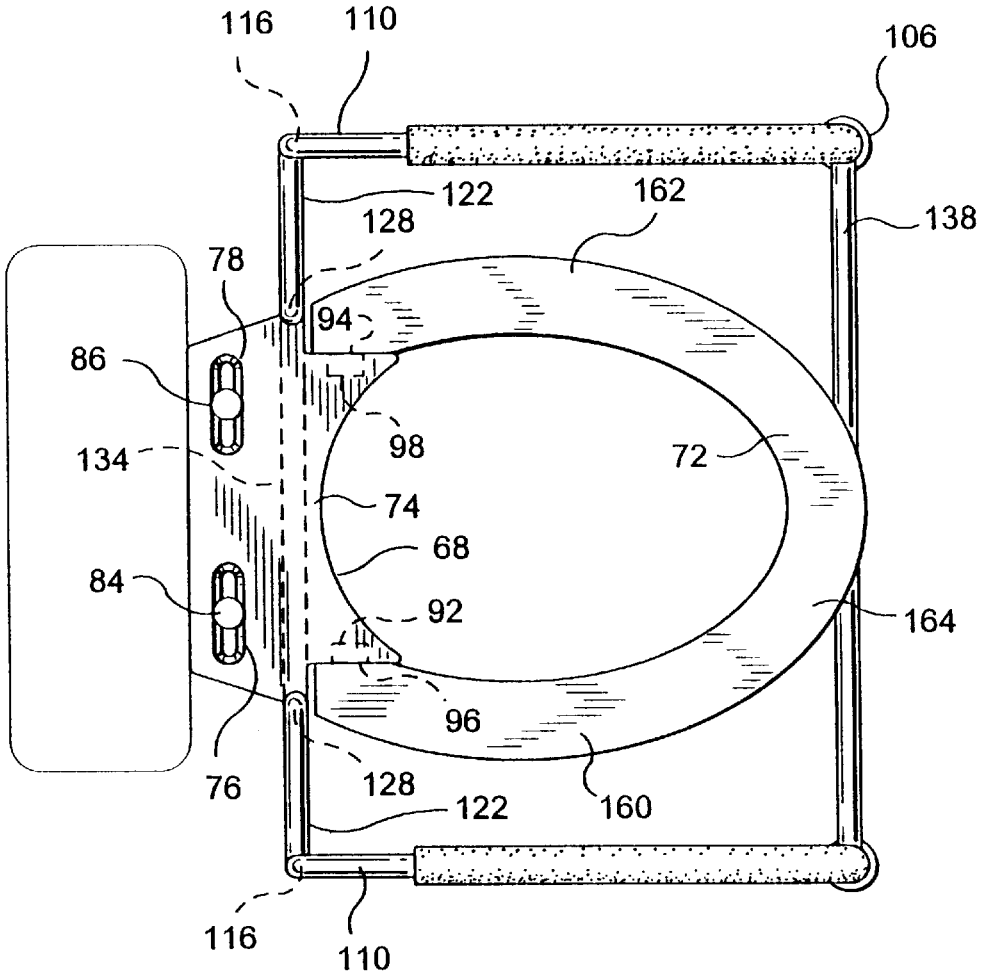
FIG. 8 is a top plan view thereof devoid of the seat and lid.

Another embodiment of a toilet seat height increasing apparatus 60 in accordance with the present invention is illustrated in FIGS. 5, 7, and 8. Similar to the above-discussed embodiment, a conventional toilet 62 has a toilet seat 64 and a lid 66 is mounted to the seat 64 in a conventional manner. The toilet 62 has toilet front and rear portions 72 and 74, respectively. The toilet seat height increasing apparatus 60 includes a mounting block 68 and a U-shaped riser 70, which is supported by the mounting block 68. A pair of elongated slots 76 and 78 (see FIGS. 9–11) are formed in the mounting block 68 transversely oriented relative to the toilet front and rear portions 72 and 74 and which extend substantially vertically through the mounting block 68 in alignment with a pair of holes 80 and 82, respectively, that extend vertically through the toilet 62 at the toilet rear portion 74. The toilet seat 64 and the lid 66 are positioned upon the mounting block 68. Both the mounting block 68 and the toilet seat 64 are secured to toilet 62 at the toilet rear portion 74 by bolts 84 and 86 that extend through the slots 76 and 78 and the holes 80 and 82, respectively, and are conventionally secured at the underside and the topside of the toilet 62 by nuts at two flanges extending from two toilet seat pivots (not shown).

The riser 70 during use rests upon a bowl 90 of the toilet 62 resulting in raising the effective height of the toilet seat 64. The riser 70 is pivotably mounted to the mounting block 68 at substantially cylindrical pins 92 and 94 that are positioned in pin recess or detents 96 and 98 that are formed in the mounting block 68 so that the riser 70 is pivotably mounted to the mounting block 68 and movable between raised and lowered riser positions relative to the toilet 62. The riser 70 can be positioned on the toilet 62 in the lowered position (shown as the riser 70A in phantom line in FIG. 7) and can be positioned away from the toilet 62 in the raised position (see FIGS. 5 and 7). The toilet seat 64A is shown in phantom line optionally positioned on the riser 70A and the lid 66A shown in phantom line optionally positioned on the toilet seat 64A when the riser is in the lowered position.

The mounting block 68 is positioned on and connected to the toilet 62 at the toilet rear portion 74. The toilet seat 64 and the lid 66 are pivotably mounted to the toilet 62 and are movable between a raised toilet seat/lid position where the toilet seat 64 and the lid 66 are pivoted to the generally vertical position as shown in FIGS. 5 and 7 and the lowered toilet seat/lid position where the toilet seat 64A is positioned upon the riser 70A with the lid 66A atop the seat 64A as shown in phantom line in FIG. 7.

For the purposes of this application, transverse direction is defined as the direction from front to rear of the toilet, whereas lateral direction is the direction extending at an angle to the transverse direction.

In accordance with the present invention a support frame 100 is used to support a user who needs assistance while sitting and lowering, rising relative to the toilet 62 and the toilet seat 64.

Figure 6:
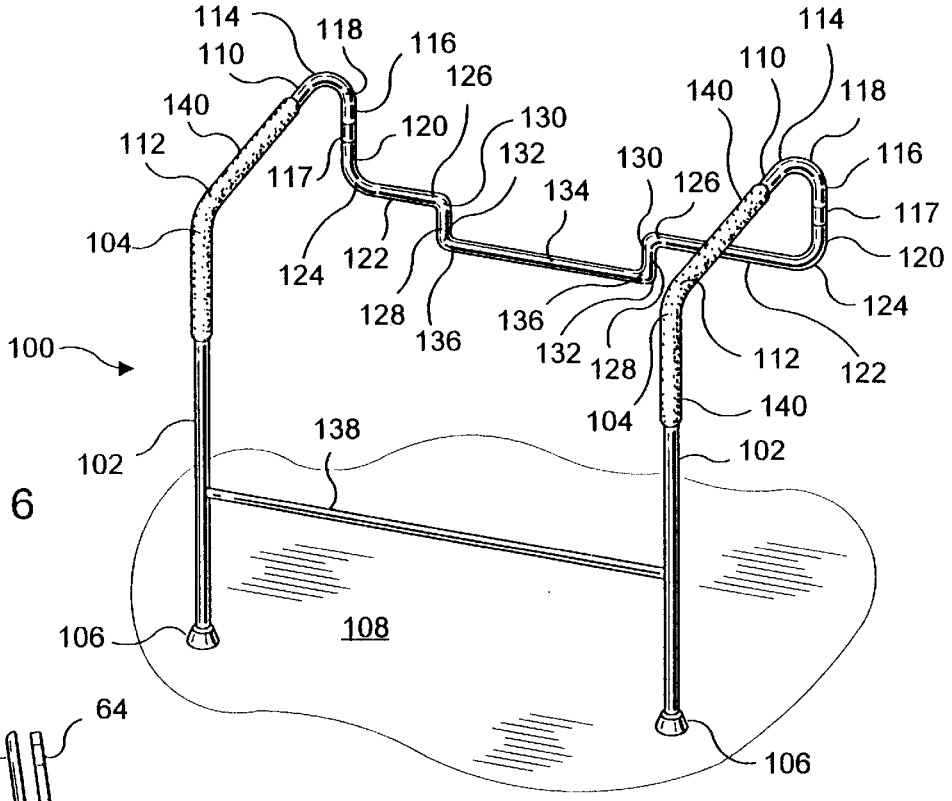
FIG. 6 is an isolated perspective view of a supporting frame.

As to the embodiment of FIG. 6, the frame 100 includes a pair of substantially vertical legs 102 having leg upper ends 104 and leg lower ends 106 resting upon a support surface 108 located at the front portion 72 of the toilet 62. A pair of substantially horizontal arms 110 having arm front and rear ends 112 and 114, respectively, extend laterally relative, to the toilet front and rear portions 72 and 74 along the opposed sides of the toilet 62. The arm front ends 112 are connected to the leg upper ends 104 and the arm rear ends 114 terminating at the toilet rear portion 74. A pair of substantially vertical outer support members 116 have outer support member upper and lower ends 118 and 120, respectively, with the outer support member upper ends 118 being connected to the corresponding arm rear ends 114. A pair of substantially horizontal upper support members 122 extend transversely relative to the toilet rear portion 74 and have upper support member outer and inner ends 124 and 126, respectively. The upper support member outer ends 124 are connected to the corresponding outer support member ends 120. A pair of substantially vertical inner support members 128 have inner support member upper and lower ends 130 and 132, respectively. The inner support member upper ends 130 are connected to the corresponding upper support member inner ends 128. A substantially horizontal support member 134 has opposed side ends 136 that are connected to the corresponding inner support member lower ends 132. A horizontal brace 138 is connected to the legs 104. The legs 102, the arms 110, the outer support members 116, the upper support members 122, the vertical support members 128, and the transverse support member 134 are preferably cylindrical in configuration but can have other suitable configuration.

The support frame 100 (see FIG. 6) can be formed either as unitary or composite structure. In the case of the composite structure, each outer support member 116 is formed having upper and lower portions which are connected together by the connecting arrangement 117. The connecting arrangement can be any conventional means of connecting together these upper and lower portions. The support frame 100 is formed by independent first and second side components and the attaching component. Each side component includes corresponding leg 102 and arm 110 as well as an upper portion of the outer support member 116, whereas the attaching component consists of the pair of substantially horizontal upper support members 122, the inner support members 128 and the horizontal support member 134. The attaching component also includes the lower portions of the outer support members 116. The above-described composite structure is provided to facilitate assembly and transportation of the support frame. Nevertheless, formation of the support frame as a unitary structure is also contemplated.

The frame 100 is made of any material capable of bearing weight, such as metal, plastic, etc. A resilient tubing 140 encloses the upper portions of the legs 102 and the arms 110.

A mounting block 68 best shown in FIGS. 9–18 includes opposed generally horizontal top and bottom faces or walls 142 and 144, respectively; opposed generally vertical block sides 146 and 148, respectively; and opposed generally vertical block front and rear sides 150 and 152, respectively. The block front side 150 defines a central curved portion 153 contoured to follow the contour of the toilet rear portion 74. The block bottom wall 144 is positioned upon the toilet rear portion 74.

The block bottom wall 144 defines a longitudinal arcuate channel 154 extending substantially horizontally between the block sides 146 and 148 transverse relative to the orientation between the toilet front and rear potions 72 and 74 and defining openings at the block vertical sides 146 and 148. In use, the substantially horizontal transverse support member 134 of the support frame 100 is received within the transverse channel 154 (See FIGS. 7 and 8). Such an arrangement secures the horizontal support member 134 and prevents transverse movement of the support frame 100 relative to the orientation of the toilet front portion 72 and the toilet rear portion 74 during use by patients or elderly persons. In use of the support frame illustrated in FIG. 1, the longitudinal arcuate, transverse channel 154 receives the substantially horizontal member 52.

In one embodiment of the invention (see FIGS. 9–15) the block sides 146 and 148 define a pair of side substantially vertical, lateral, arcuate channels 156 and 158 extending between the block top and bottom walls 142 and 144 defining openings coextensive with the side openings formed by the longitudinal, transverse channel 154. In operation, the substantially vertical inner support members 128 of the frame 100 are positioned in the vertical, lateral channels 156 and 158, so as to secure the vertical inner support members 128 and prevent lateral movement of the support frame 100 relative to the orientation of the toilet front portion 72 and the toilet rear portion 74.

The mounting block can be also arranged without the side vertical channels, so the surfaces of the block sides are flat. This embodiment of the mounting block accommodates the support frame illustrated in FIGS. 1–4 which is formed without a step-like portion defined by the pair of vertical inner support members and the horizontal support member.

The U-shaped riser 70, as best illustrated in FIGS. 5 and 8, is made of a biasable material and includes opposed riser side members 160 and 162 and a curved joining portion 164 all configured to mate with the toilet seat 64. In order to provide proper connection with the riser, a part of each block side of the mounting block adjacent the front side 150 defines a step-like formation with mounting side members 171 and 175. The mounting side members 171 and 175 of the mounting block define generally cylindrical detent recess 96 and 98, respectively. The pins 92 and 94 extend transversely from the riser side members 160 and 162, respectively, and are engaged within the detent recesses 96 and 98, respectively. In this manner the riser 70 can be pivoted between the raised, lowered and vice versa riser positions described hereinbefore.

The mounting side members 171 and 175 of the vertical sides 146 and 148, respectively, define channels 166 each including channel tapered surfaces 168 contiguous with opposed channel side walls 170. The block vertical sides 146 and 148 define opening 172 at the block bottom wall 144. The channels 166 extend from the openings 172 in the direction of the detent recesses 96 and 98. During the process of mounting the riser 70 to the mounting block 68, the pins 92 and 94 are initially positioned at the openings 172. The distance between the tapered surfaces 168 gradually increases from the block bottom wall 144 to the detent recess 96 and 98, so that during the mounting process, as the pins 92 and 94 of riser 70 are directed along the channels 166 over the tapered surfaces 168, the riser side members 160 and 162 of the U-shaped riser 70 are forced apart from a non-biased mode to an ever increasing biased mode. When the pins 92 and 94 reach the detent recesses 96 and 98, the riser side members 160 and 162 self-bias back from the biased mode to the unbiased mode, so that the pins 92 and 94 snap into the detent recesses 96 and 98 for engagement therein. Thus, that the riser 70 is pivotably connected to the mounting block 68.

Figure 9:
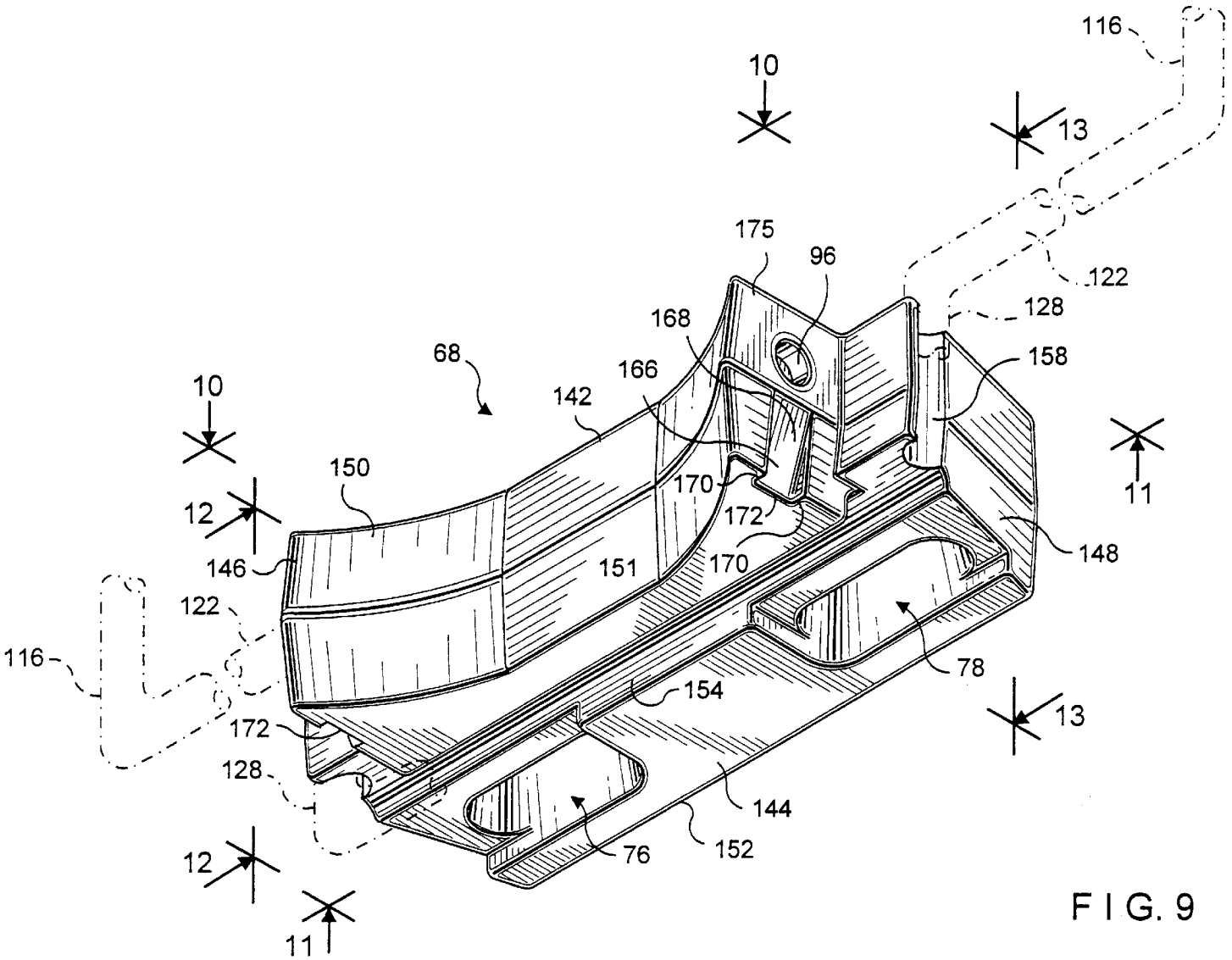
FIG. 9 is an isolated perspective view of a mounting block of the invention.
Figure 10:
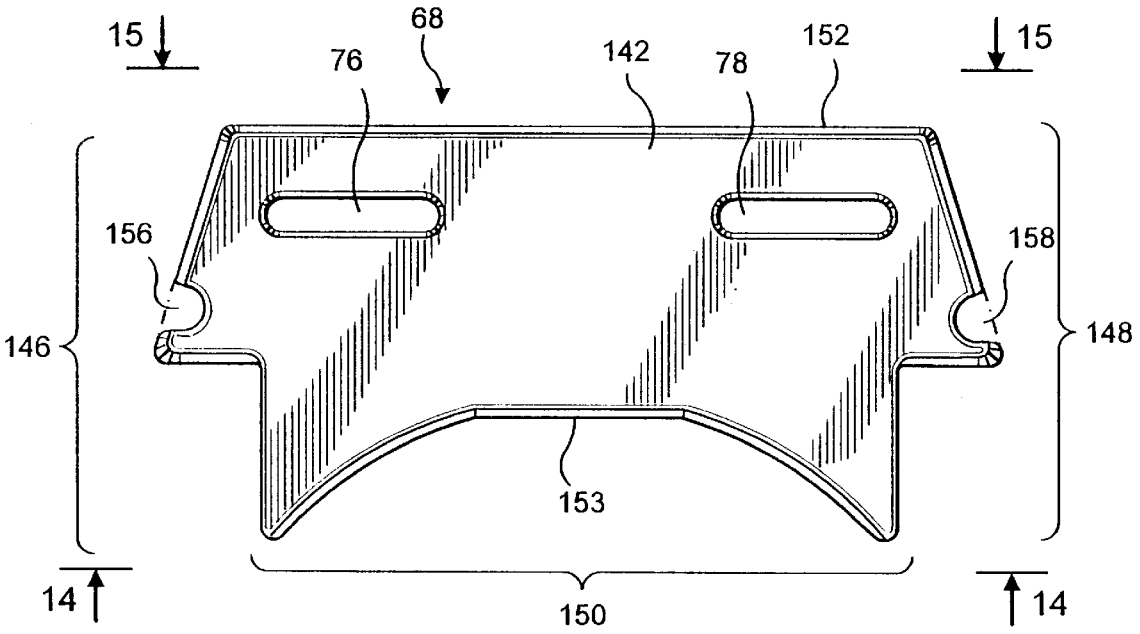
FIG. 10 is a top plan view of the mounting block taken through plane 10—10 of FIG. 9.
Figure 11:
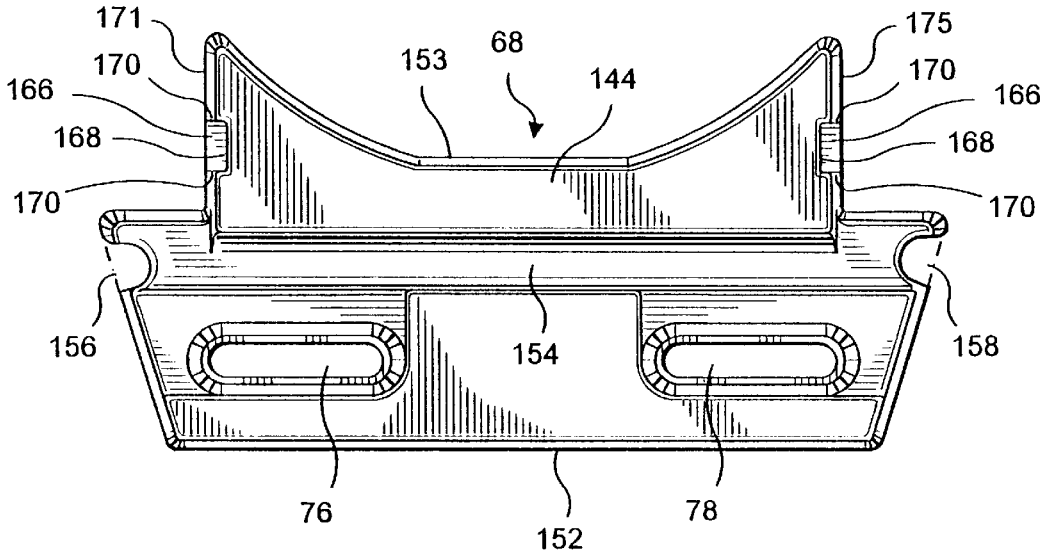
FIG. 11 is a bottom plan view of the mounting block taken through plane 11—11 of FIG. 9.
Figure 12:
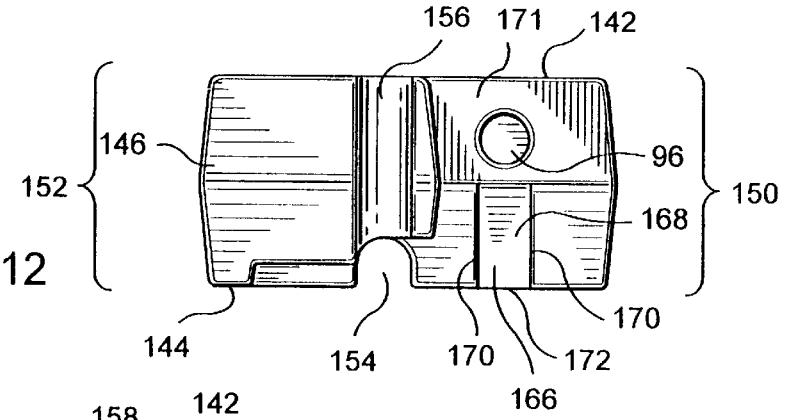
FIG. 12 is a side elevational view of the mounting block taken through plane 12—12 of FIG. 9.
Figure 13:
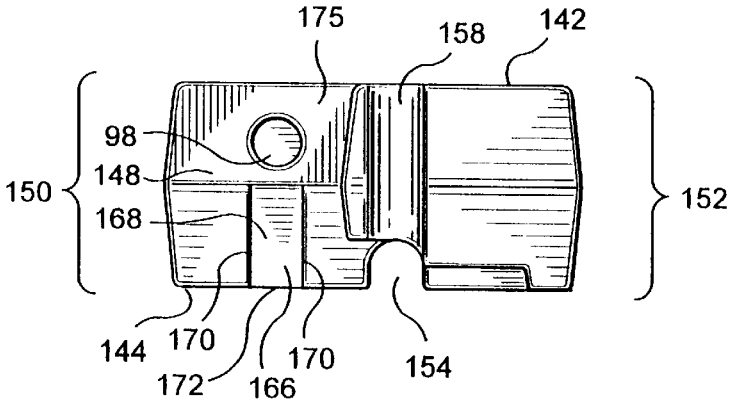
FIG. 13 is a side elevational view of the mounting block taken through plane 13—13 of FIG. 9.
Figure 14:
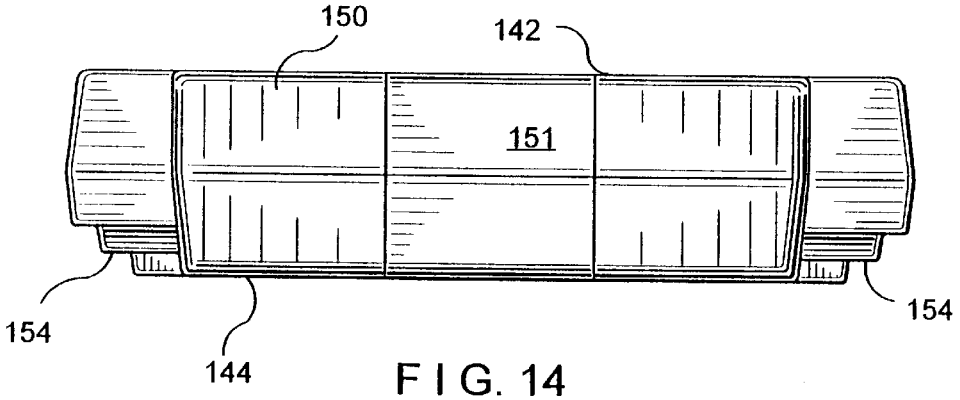
FIG. 14 is a front elevational view of the mounting block taken through line 14—14 of FIG. 10.
Figure 15:
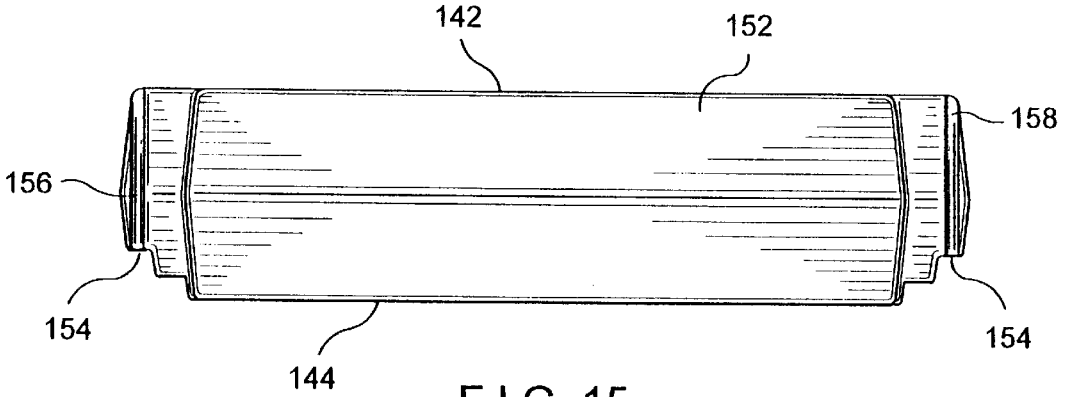
FIG. 15 is a rear elevational view of the mounting block taken through line 15—15 of FIG. 10.
Figure 16:
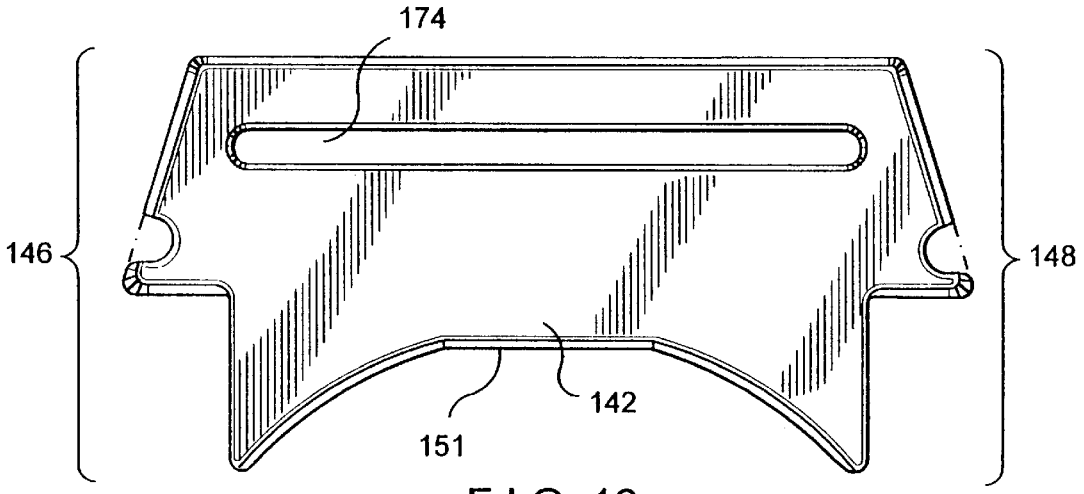
FIG. 16 is a top plan view of the mounting block illustrating a single mounting slot.

A variation of the pair of the elongated slots 76 and 78 shown in FIGS. 9, 10, and 11, which extend transversely between the block vertical sides 146 and 148, is a single elongated slot 174 shown in FIG. 16 which is defined by the mounting block 68 and which extends transversely relative to the toilet front portion 72 and the rear portion 74 orientation between the block vertical sides 146 and 148. The single elongated slot 174 extends substantially vertically through the mounting block 68. The single elongated slot 174 is capable of being aligned with a plurality of spacings between the preformed mounting holes 80 and 82 defined in the toilet 62. Therefore, during the assembly the connecting bolts 84 and 86 pass through the holes 80 and 82 and the single slot 174.

Figure 17:
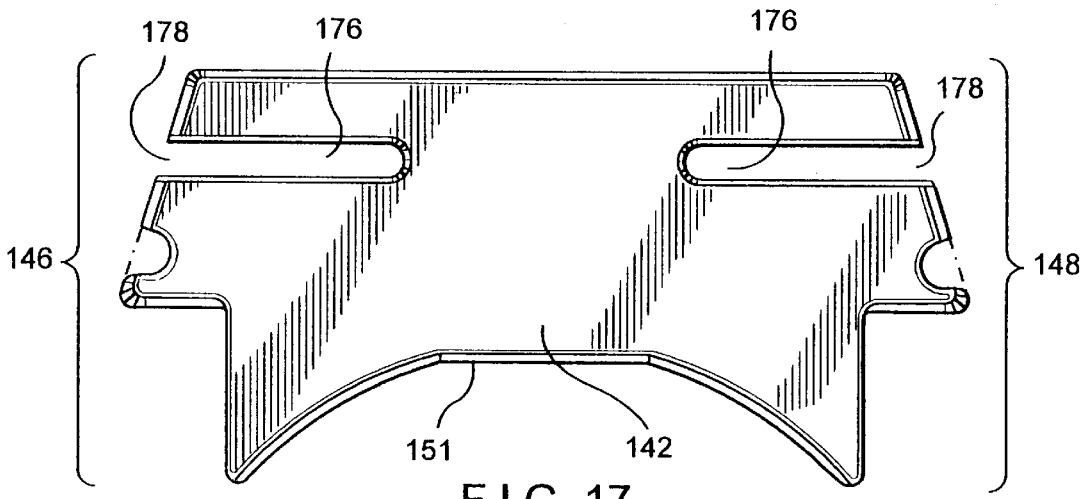
FIG. 17 is a top plan view of the mounting block illustrating a pair of mounting slots at the mounting block side walls.

Another variation is a pair of elongated slots 176 shown in FIG. 17 which extend transversely relative to the toilet front portion 72 and the toilet rear portion 74 orientation between the block vertical sides 146 and 148 and vertically through the mounting block 68. Each of the slots 176 extend to the block vertical sides 146 and 148 where the apertures 178 are defined. The slots 176 are capable of being aligned with a plurality of spacings of the preformed mounting holes 80 and 82 defined in the toilet 62 in preparation for the connecting bolts 84 and 86 passing through the holes 80 and 82 and the slots 176 including apertures 178.

Figure 18:
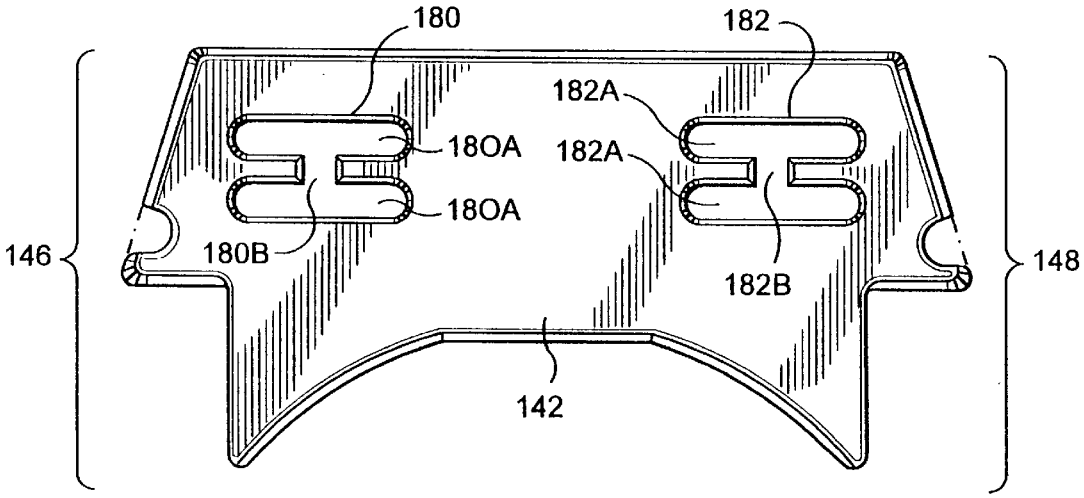
FIG. 18 is a top plan view of the mounting block illustrating two pairs of double mounting slots with each pair connected by a joining slot.

Another variation of the slots 76 and 78, the single slot 174, and the pair of slots 176 is a pair of elongated multiple slots 180 and 182. In the embodiment of FIG. 18, such multiple slots are double slots which are defined by the mounting block 68 extending transversely between the block vertical sides 146 and 148 and which extend transversely relative to the toilet front portion 72 and the toilet rear portion 74 orientation and vertically through the mounting block 68. Each of double slot 180 and 182 comprises a pair of substantially parallel slots 180A and 182A, respectively, joined at midpoint by short slots 180B and 182B, respectively. The double slots 180 and 182 are capable of being aligned with a plurality of spacings of the preformed mounting holes 80 and 82 defined in toilets in preparation for the connecting bolts 84 and 86 passing through the holes 82 and the single slot 170.

The mounting block 68 and the riser 70 may be fabricated of a suitable plastic material suitably molded into the configuration required, while the toilet 62 may be of conventional porcelain. Moreover, the present invention provides apparatus by which a conventional toilet seat and lid may be utilized in a conventional manner.

Although the present invention has been described in some detail by way of illustration and example for purposes of clarity and understanding, it will, of course, he understood that various changes and modifications may be made in the form, details, and arrangements of the parts without departing from the scope of the invention set forth in the following claims.

What is claimed is:

1. A toilet height conversion structure for use in combination with a supporting frame associated with a toilet having at least a rear portion, said supporting frame including at least a substantially horizontal support member, said structure comprising:

a mounting block positionable at the rear portion of said toilet, riser means for raising the effective height of a toilet seat, said riser means being pivotably connected to said mounting block for movement between raised and lowered positions of said riser means relative to the toilet, said mounting block including opposed mounting side members, said mounting side members defining opposed detent recesses and said riser means including opposed riser side walls having a pair of pivot pins provided for alignment and engagement with said detent recesses, said riser means being formed of a biasable material and said mounting side members further including taper means for initially accepting said pair of pins during the mounting of said riser means to said mounting block and directing said pins to said detent recesses, said riser means being movable from a non-biased mode to a biased mode during mounting and self-biased from the biased mode to the non-biased mode upon engagement within said detent recesses, said mounting block is formed with transverse channel means for securing said substantially horizontal support member of said supporting frame and preventing transverse movement of said supporting frame relative to the toilet.

2. The structure of claim 1, further comprising adjustable connecting means for securing said mounting block to the rear portion of the toilet.

3. The structure according to claim 2, wherein said adjustable connecting means is a slot arrangement provided for alignment with preformed mounting holes defined in the toilet.

4. The structure according to claim 3, wherein said slot arrangement in said mounting block defining a single elongated transversely extending slot extending between said top and bottom block walls and generally between said block side walls, whereby said single elongated slot is capable of being aligned with a plurality of possible spacings of preformed mounting holes defined in the toilet.

5. The structure according to claim 3, wherein said slot arrangement in said mounting block defining a pair of elongated slots extending between said top and bottom walls and passing through said block side walls, so that apertures are defined at junctions of said block side walls with said elongated slots facilitating securing of the block to the toilet.

6. The structure according to claim 3, wherein said slot arrangement in said mounting block defining a pair of elongated transversely extending slot combinations extending between said top and bottom walls and generally between said block side walls, each said slot combination including at least two mating elongated transversely extending slots and a lateral slot for joining said mating slots.

7. The structure according to claim 1, wherein said mounting block further includes opposed top and bottom block walls, said bottom block wall being positionable upon the toilet rear portion, said transverse channel means formed at said bottom block wall defining a substantially horizontal transverse channel passing through the mounting block, said horizontal support member of the supporting frame being positionable within said substantially horizontal transverse channel.

8. A toilet height conversion structure for use in combination with a supporting frame associated with a toilet having at least a rear portion said supporting frame including at least a substantially horizontal support member and a pair of substantially vertical inner support members, said structure comprising:

a mounting block positionable at the rear portion of said toilet, riser means for raising the effective height of a toilet seat, said riser means being pivotably connected to said mounting block for movement between raised and lowered positions of said riser means relative to the toilet, adjustable connecting means for securing said mounting block to the rear portion of the toilet, said mounting block formed with transverse channel means for securing said substantially horizontal support member of said supporting frame and preventing transverse movement of said supporting frame relative to the toilet, said mounting block including lateral channel means for securing said pair of substantially vertical inner support members to prevent lateral movement of said supporting frame relative to the toilet.

9. The structure according to claim 8, wherein said mounting block further includes opposed top and bottom block walls, said transverse channel means formed at said bottom block wall defining a substantially horizontal transverse channel passing through the mounting block, said substantially horizontal support member of the supporting frame being positionable within said substantially horizontal transverse channel.

10. The structure according to claim 9, wherein said mounting block further includes opposed block side walls and said lateral channel means being formed at said opposed block side walls defining a pair of substantially vertical channels in alignment with ends of said substantially horizontal transverse channel, said substantially vertical inner support members being positioned in said pair of substantially vertical channels.

11. The structure according to claim 10, wherein said adjustable connecting means is a slot arrangement provided for alignment with preformed mounting holes defined in the toilet.

12. The structure according to claim 11, wherein said slot arrangement in said mounting block defining a single elongated transversely extending slot extending between said top and bottom block walls and generally between said block side walls, whereby said single elongated slot is capable of being aligned with a plurality of possible spacings of preformed mounting holes defined in the toilet.

13. The structure according to claim 11, wherein said slot arrangement in said mounting block defining a pair of elongated slots extending between said top and bottom walls and passing through said block side walls, so that apertures are defined at junctions of said block side walls with said elongated slots facilitating securing of the block to the toilet.

14. The structure according to claim 11, wherein said slot arrangement in said mounting block defining a pair of elongated transversely extending slot combinations extending between said top and bottom walls and generally between said block side walls, each said slot combination including at least two mating elongated transversely extending slots and a lateral slot for joining said mating slots.

15. The structure according to claim 8, wherein said mounting block includes opposed mounting side members, said mounting side members defining opposed detent recesses and said riser means includes opposed riser sides walls having a pair of pivot pins provided for alignment and engagement with said detent recesses.

16. The structure according to claim 15, wherein said riser means is made of a biasable material and said mounting side members further include taper means for initially accepting said pair of pins during the mounting of said riser means to said mounting block and directing said pins to said detent recesses, said riser means being movable from a non-biased mode to a biased mode during mounting and self-biased from the biased mode to the non-biased mode upon engagement within said detent recesses.

17. A toilet height conversion structure for use in combination with a toilet having a rear portion and a frame for supporting a user, said frame resting upon the rear portion of the toilet, said frame including at least a substantially horizontal support member and a pair of substantially vertical inner support members, said structure comprising:

a mounting block positionable at the rear portion of said toilet;

a riser for raising the effective height of a toilet seat, said riser being pivotably connected to said mounting block for movement between raised and lowered positions of said riser relative to the toilet:

a frame including at least a substantially horizontal support member and a pair of substantially vertical inner support members;

a transverse channel means associated with said mounting block for securing said horizontal support member and preventing transverse movement of said frame relative to the toilet;

lateral channel means associated with said mounting block for securing said pair of vertical inner support members and preventing lateral movement of said frame means relative to the toilet, and adjustable connecting means for securing said mounting block at the rear portion of the toilet.

18. The structure according to claim 17, wherein said mounting block includes opposed top and bottom block walls, said bottom block wall being positioned upon the toilet rear portion, said transverse channel means is a substantially horizontal channel defined at said bottom block surface, said horizontal support member being positioned within said substantially horizontal channel.

19. The structure according to claim 18, wherein said lateral channel means is a pair of substantially vertical channels, said mounting block further includes opposed block side walls defining said substantially vertical channels in alignment with said substantially horizontal channel, said vertical inner support members being positioned in said substantially vertical channels.

* * * * *